US010165805B2

(12) United States Patent
Yuen

(10) Patent No.: US 10,165,805 B2
(45) Date of Patent: Jan. 1, 2019

(54) BOTTOM GARMENT WITH BUTTOCK LIFTING FEATURE

(71) Applicant: Tak Yu Yuen, Kowloon (HK)

(72) Inventor: Tak Yu Yuen, Kowloon (HK)

(73) Assignee: Delta Global Sourcing Limited, Kowloon (HK)

( * ) Notice: Subject to any disclaimer, the term of this patent is extended or adjusted under 35 U.S.C. 154(b) by 76 days.

(21) Appl. No.: 14/958,908

(22) Filed: Dec. 3, 2015

(65) Prior Publication Data

US 2017/0156410 A1 Jun. 8, 2017

(51) Int. Cl.

| | |
|---|---|
| ***A41C 1/00*** | (2006.01) |
| ***A41D 1/06*** | (2006.01) |
| *A41D 27/20* | (2006.01) |

(52) U.S. Cl.

CPC ..... *A41D 1/06* (2013.01); *A41D 27/204* (2013.01); *A41D 2400/38* (2013.01)

(58) Field of Classification Search

CPC ..... A41C 1/00; A41D 27/20; A41D 27/00; A41D 27/02; A41D 27/08

USPC ..... 450/100, 150, 152, 155, 132, 11; 2/250, 2/249

See application file for complete search history.

(56) References Cited

U.S. PATENT DOCUMENTS

| | | | | |
|---|---|---|---|---|
| 3,435,462 | A * | 4/1969 | Bank | A41D 1/06 2/227 |
| 4,599,750 | A * | 7/1986 | Rahaman | A41D 27/00 2/227 |
| 5,161,393 | A * | 11/1992 | Payne | D06F 39/003 68/12.04 |
| 5,566,397 | A * | 10/1996 | Scott | A41F 9/002 2/221 |
| 5,874,372 | A * | 2/1999 | Morishita | D03D 15/08 139/421 |
| 2004/0205879 | A1* | 10/2004 | Leba | A41D 27/20 2/247 |
| 2005/0202741 | A1* | 9/2005 | Onodera | D03D 1/007 442/189 |
| 2008/0268734 | A1* | 10/2008 | Tharpe | D01H 1/00 442/184 |
| 2009/0042473 | A1* | 2/2009 | Imai | B32B 5/02 442/183 |
| 2014/0075640 | A1* | 3/2014 | Carson | A41D 1/02 2/69 |

* cited by examiner

*Primary Examiner* — Timothy K Trieu

(57) ABSTRACT

A bottom garment with buttock lifting feature with a tape attached to an inner side of the seat area corresponding to each of the back pockets, such that the tape extends downwardly from the waist area along and inside a stitching line of the outer lateral edge of the back pocket to the lower end of the outer lateral edge, then extends laterally from the lower end of the outer lateral edge along and inside a stitching line of the bottom edge to the lower end of the inner lateral edge, and finally extends upwardly from the lower end of the inner lateral edge along and inside a stitching line of the inner lateral edge to the waist area.

9 Claims, 2 Drawing Sheets

BOTTOM GARMENT WITH BUTTOCK LIFTING FEATURE

BACKGROUND OF THE INVENTION

The present invention relates to an article of clothing and more particularly pertains to a bottom garment with buttock lifting feature.

Bottom garments with buttock lifting feature are available in the marketplace. Such garments are typically provided with extra panels sewn inside the bottom garments which are configured to accentuate wearer's buttocks. However, such addition of extra panels results in more complicated manufacturing process, thus increases manufacturing costs.

BRIEF SUMMARY OF THE INVENTION

In view of the aforesaid disadvantages now present in the prior art, the present invention provides a bottom garment with buttock lifting feature with is simple in structure and thus low in manufacturing costs.

To attain this, the present invention generally comprises a seat area, a waist area, two back pockets and a tape. The two back pockets are provided symmetrically at an outer side of the seat area respectively. Each of the back pockets has an outer lateral edge, an inner lateral edge opposite the outer lateral edge, and a bottom edge connecting a lower end of the outer lateral edge and a lower end of the inner lateral edge. The tape is attached to an inner side of the seat area corresponding to each of the back pockets, such that the tape extends downwardly from the waist area along and inside a stitching line of the outer lateral edge of the back pocket to the lower end of the outer lateral edge, then extends laterally from the lower end of the outer lateral edge along and inside a stitching line of the bottom edge to the lower end of the inner lateral edge, and finally extends upwardly from the lower end of the inner lateral edge along and inside a stitching line of the inner lateral edge to the waist area.

In one embodiment, an upper outer portion of the tape between the waist area and a top end of the stitching line of the outer lateral edge of the back pocket and an upper inner portion of the tape between the waist area and a top end of the stitching line of the inner lateral edge of the back pocket are left loose and not attached to the inner side of the seat area.

In one embodiment, the tape may be made of a non-elastic fabric, which for example may be a fabric consisting of 100% polyester.

In one embodiment, the waist area is in form of a contour waistband made of a plurality of waistband members sewn together. The plurality of waistband members comprises an outside left front waistband, an outside right front waistband, an inside right front waistband, an inside left front waistband, an outside back waistband and an inside back waistband. The inside back waistband is made of an elastic fabric which for example may be an elastic fabric consisting of 30% polypropylene, 30% polyester and 40% latex.

In one embodiment, the bottom garment is a mid-rise bottom garment.

In one embodiment, the bottom garment is made of a stretchable fabric and sewn with strong and stretchable threads. The stretchable fabric is stretchable in all directions with an elongation percentage of over 30-50% and a stretch recovery percentage of less than 6% fabric growth on weft stretch direction.

In one embodiment, the bottom garment has back side belt loops extending from top of the waist area to back yoke of the bottom garment.

In one embodiment, the bottom garment is configured to provide at least a tight fit between the bottom garment and wearer's legs.

In one embodiment, the back pockets are positioned and sized in such a way so that the back pockets are centrally positioned in relation to two sides of wearer's buttock respectively.

DETAILED DESCRIPTION OF THE INVENTION

Figure 1:
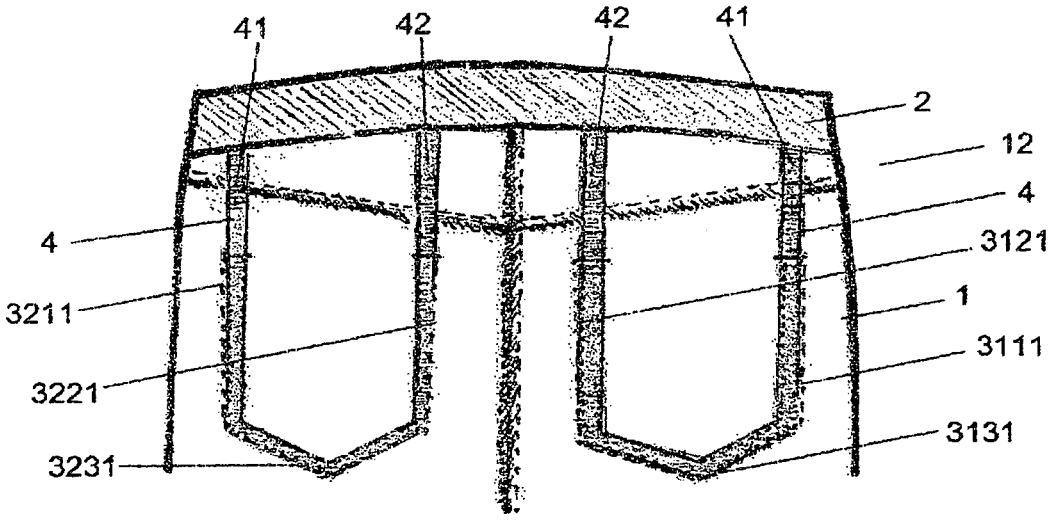
FIG. 1 illustrates an inner side of the seat area of the bottom garment according to an embodiment of the present invention.
Figure 2:
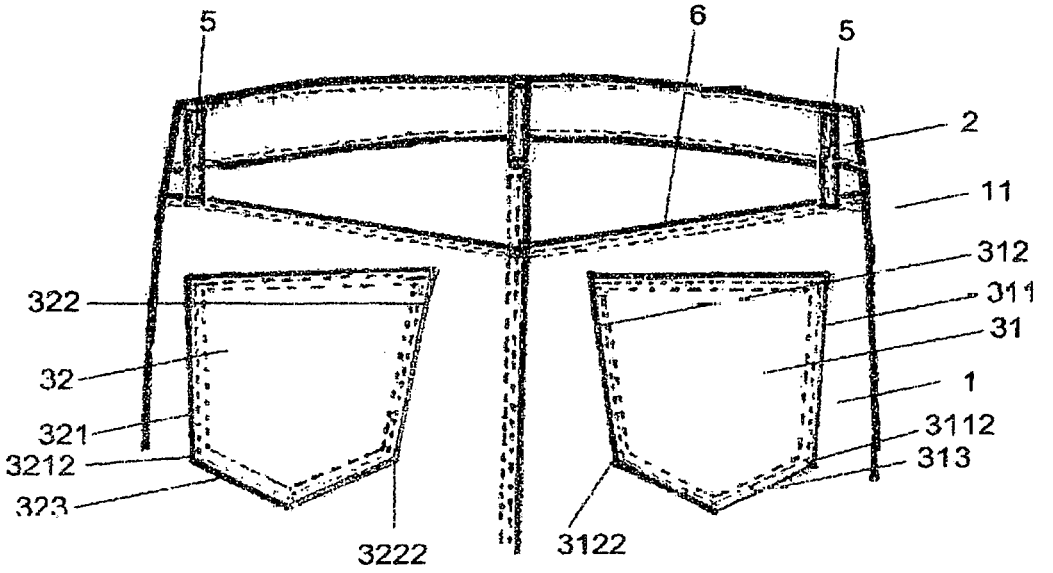
FIG. 2 illustrates an outer side of the seat area of the bottom garment according to an embodiment of the present invention.
Figure 3:
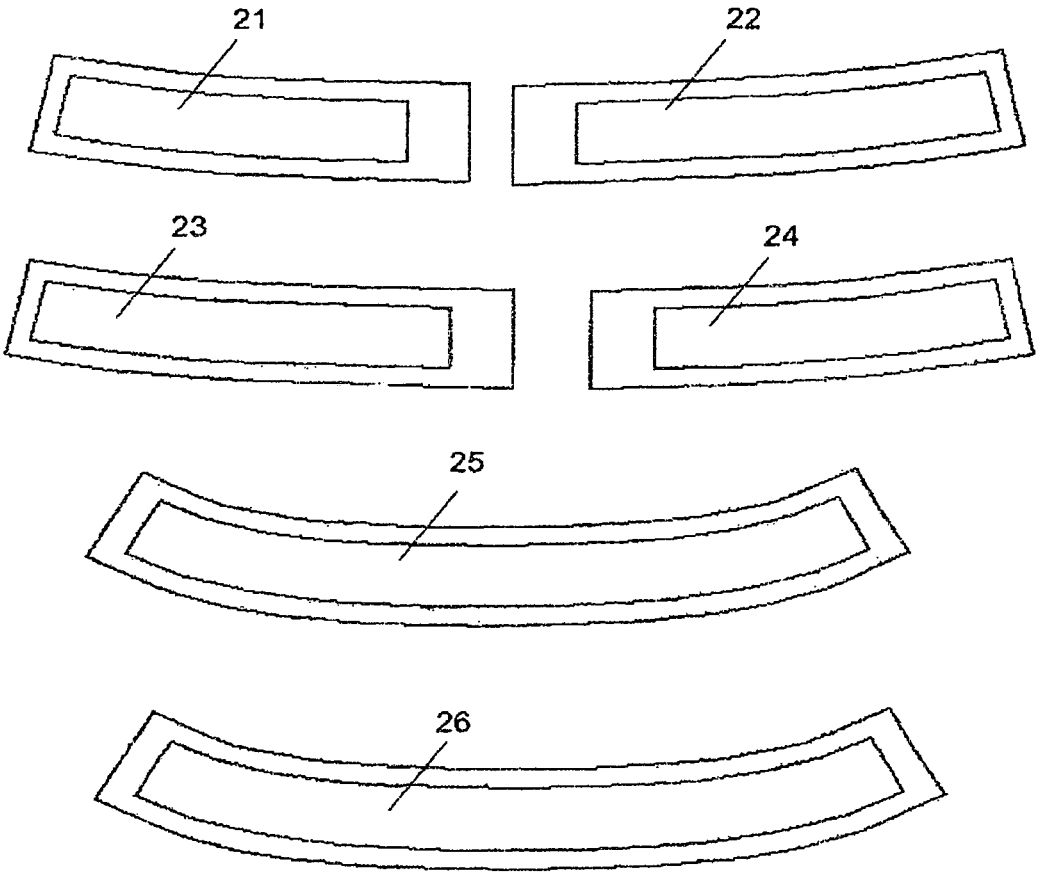
FIG. 3 illustrates the plurality of waistband members of the bottom garment according to an embodiment of the present invention.

As illustrated in FIGS. 1 to 3, an embodiment of the present invention comprises a seat area 1, a waist area 2, two back pockets 31, 32 and a tape 4. The two back pockets 31, 32 are provided symmetrically at an outer side 11 of the seat area 1 respectively. Each of the back pockets 31, 32 has an outer lateral edge 311, 321, an inner lateral edge 312, 322 opposite the outer lateral edge 311, 321, and a bottom edge 313, 323 connecting a lower end 3112, 3212 of the outer lateral edge 311, 321 and a lower end 3122, 3222 of the inner lateral edge 312, 322. The tape 4 is attached to an inner side 12 of the seat area 1 corresponding to each of the back pockets 31, 32, such that the tape 4 extends downwardly from the waist area 2 along and inside a stitching line 3111, 3211 of the outer lateral edge 311, 321 of the back pocket 31, 32 to the lower end of the outer lateral edge 311, 321, then extends laterally from the lower end of the outer lateral edge 311, 321 along and inside a stitching line 3131, 3231 of the bottom edge 313, 323 to the lower end of the inner lateral edge 312, 322, and finally extends upwardly from the lower end of the inner lateral edge 312, 322 along and inside a stitching line 3121, 3221 of the inner lateral edge 312, 322 to the waist area 2. In this embodiment, an upper outer portion 41 of the tape 4 between the waist area 2 and a top end of the stitching line 3111, 3211 of the outer lateral edge 311, 321 of the back pocket 31, 32 and an upper inner portion 42 of the tape 4 between the waist area 2 and a top end of the stitching line 3121, 3221 of the inner lateral edge 312, 322 of the back pocket 31, 32 are left loose and not attached to the inner side 12 of the seat area 1. This has the advantage of preventing the stitching lines of the upper outer portion 41 and upper inner portion 42 of the tape 4 from being visible at the outer side 11 of the seat area 1. However, in an alternative embodiment, the entire tape 4 may be sewn to the inner side 12 of the seat area 1. The tape 4 is made of a non-elastic fabric, which in this embodiment is a fabric consisting of 100% polyester. The tape 4 is effective in maintaining the position of the seat area 1 of the bottom garment, thereby achieving buttock lifting effect.

In this embodiment, the waist area 2 is in form of a contour waistband made of a plurality of waistband members sewn together. The plurality of waistband members comprises an outside left front waistband 21, an outside right front waistband 22, an inside right front waistband 23, an inside left front waistband 24, an outside back waistband 25 and an inside back waistband 26. The inside back waistband 26 is made of an elastic fabric which in this embodiment is an elastic fabric consisting of 30% polypropylene, 30% polyester and 40% latex. The inside back waistband 26 made in this manner is effective in keeping the inside back waistband 26 to fit around the wearer's waist so that the buttock lifting effect is enhanced.

In this embodiment, the bottom garment is a mid-rise bottom garment. The bottom garment is made of a stretchable fabric and sewn with strong and stretchable threads. The stretchable fabric is stretchable in all directions with an elongation percentage of over 30-50% and a stretch recovery percentage of less than 6% fabric growth on weft stretch direction. For example, the stretchable fabric may be a fabric consisting of 72.25% cotton, 25.25% polyester and 2.5% of spandex, a fabric consisting of 87.5% cotton, 9.8% polyester and 2.7% of LYCRA which is an elastic synthetic fiber, or a fabric consisting of 72.2% of cotton, 25.3% of Elasterell-P and 2.5% of LYCRA which is an elastic synthetic fiber. The strong and stretchable threads may for example comprise a needle thread with a Tex size of 60, a Metric size of 50, a Denier Size Finished/Ply of 625.64/3, a strength of 4.51 lbs. and an elongation (elongation at break (%)) of 48.74, and a bobbin thread with a Tex size of 105, a Metric size of 27, a Denier Size Finished/Ply of 1170.58/3, a strength of 8.15 lbs. and an elongation (elongation at break (%)) of 52.47.

In this embodiment, the bottom garment has back side belt loops 5 extending from top of the waist area 2 to back yoke 6 of the bottom garment. The bottom garment is configured to provide at least a tight fit between the bottom garment and wearer's legs. The back pockets are positioned and sized in such a way so that the back pockets are centrally positioned in relation to two sides of wearer's buttock respectively.

The above embodiment is an embodiment of the present invention. The present invention is capable of other embodiments and is not limited by the above embodiments. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A bottom garment with buttock lifting feature which comprises a seat area and a waist area;

two back pockets provided symmetrically at an outer side of the seat area respectively;

each of the back pockets has an outer lateral edge, an inner lateral edge opposite the outer lateral edge, and a bottom edge connecting a lower end of the outer lateral edge and a lower end of the inner lateral edge; and a tape attached to an inner side of the seat area corresponding to each of the back pockets, such that the tape extends downwardly from the waist area within a boundary defined by stitches of the outer lateral edge of the back pocket to the lower end of the outer lateral edge, then extends laterally from the lower end of the outer lateral edge within a boundary defined by stitches of the bottom edge to the lower end of the inner lateral edge, and finally extends upwardly from the lower end of the inner lateral edge within a boundary defined by stitches of the inner lateral edge to the waist area;

the waist area is in form of a contour waistband made of a plurality of waistband members sewn together;

the plurality of waistband members comprises an outside left front waistband, an outside right front waistband, an inside right front waistband, an inside left front waistband, an outside back waistband and an inside back waistband; the inside back waistband is made of an elastic fabric.

2. The bottom garment as in claim 1, wherein an upper outer portion of the tape between the waist area and an uppermost of the stitches of the outer lateral edge of the back pocket and an upper inner portion of the tape between the waist area and an uppermost of the stitches of the inner lateral edge of the back pocket are left loose and not attached to the inner side of the seat area.

3. The bottom garment as in claim 1, wherein the tape is made of a non-elastic fabric.

4. The bottom garment as in claim 1, wherein the elastic fabric consists of 30% polypropylene, 30% polyester and 40% latex.

5. The bottom garment as in claim 1, wherein the bottom garment is made of a stretchable fabric and sewn with strong and stretchable threads.

6. The bottom garment as in claim 5, wherein the stretchable fabric is stretchable with respect to an unstretched length of the stretchable fabric by over 30-50%; when the stretchable fabric is recovered from a stretched condition back to an unstretched condition, the stretchable fabric has less than 6% fabric growth on weft stretch direction with respect to the unstretched length of the stretchable fabric.

7. The bottom garment as in claim 1, wherein the bottom garment has back side belt loops extending from top of the waist area to back yoke of the bottom garment.

8. The bottom garment as in claim 1, wherein the bottom garment is configured to provide at least a tight fit between the bottom garment and wearer's legs.

9. The bottom garment as in claim 1, wherein the back pockets are positioned and sized to be centrally positioned in relation to two sides of a wearer's buttock respectively when the bottom garment is worn.

* * * * *